US005918374A

United States Patent [19]

Campbell et al.

[11] Patent Number: 5,918,374

[45] Date of Patent: Jul. 6, 1999

[54] SIGHT FOR A FIREARM AND FIREARM INCLUDING SAME

[75] Inventors: Hugh Alexander Campbell, Inverness; Ian Fraser Thompson, Ross-shire, both of United Kingdom

[73] Assignee: Thompson & Campbell Limited, United Kingdom

[21] Appl. No.: 08/934,151

[22] Filed: Sep. 23, 1997

[30] Foreign Application Priority Data

Sep. 27, 1996 [GB] United Kingdom ..... 9620143

[51] Int. Cl.[6] ..... F41G 1/26; F41G 21/00; F41C 1/38; F41C 3/14

[52] U.S. Cl. ..... 33/233; 42/100; 42/101; 33/261; 33/245

[58] Field of Search ..... 33/261, 260, 259, 33/255, 252, 251, 254; 42/100

[56] References Cited

U.S. PATENT DOCUMENTS

| | | | |
|---|---|---|---|
| 1,454,865 | 5/1923 | Seely | 42/100 |
| 2,367,342 | 1/1945 | Eiane | 33/252 |
| 2,645,017 | 7/1953 | Haase | 42/100 |
| 2,727,309 | 12/1955 | Jenkins | 42/100 |
| 2,781,583 | 2/1957 | Grimble | 42/100 |
| 3,626,597 | 12/1971 | Darrah | 33/252 |
| 3,838,522 | 10/1974 | Williams | 42/100 |
| 3,945,142 | 3/1976 | Keppeler | 42/1 |
| 4,021,926 | 5/1977 | Hrebar | 33/261 |
| 4,479,307 | 10/1984 | Pomeranz | 42/100 |
| 4,686,770 | 8/1987 | Aigner | 33/253 |
| 4,841,659 | 6/1989 | Williams | 33/261 |
| 5,016,382 | 5/1991 | Pickle | 42/100 |

FOREIGN PATENT DOCUMENTS

| | | | |
|---|---|---|---|
| 138325 | 8/1950 | Australia | 33/254 |
| 145982 | 4/1952 | Australia | 33/253 |
| 349006 | 5/1931 | United Kingdom . | |
| 571027 | 8/1945 | United Kingdom . | |
| 582271 | 11/1946 | United Kingdom . | |
| 605272 | 7/1948 | United Kingdom . | |
| 622054 | 4/1949 | United Kingdom . | |
| 942724 | 11/1963 | United Kingdom . | |
| 952372 | 3/1964 | United Kingdom | 33/254 |
| 1034257 | 6/1966 | United Kingdom . | |
| A-2131927 | 6/1984 | United Kingdom . | |

*Primary Examiner*—Charles T. Jordan
*Assistant Examiner*—Denise J. Buckley
*Attorney, Agent, or Firm*—Heslin & Rothenberg, P.C.

[57] ABSTRACT

A sight having a foresight includes a main body that has an internal bore therethrough such that the main body can receive the barrel of a firearm. A spring-biased body located in the main body includes at least a portion thereof biased towards the internal bore of the main body so that it can engage an indentation formed on the barrel of the fire to secure the foresight on the barrel. The sight may also include a rearsight which may be releasable fixed to the barrel.

16 Claims, 5 Drawing Sheets

SIGHT FOR A FIREARM AND FIREARM INCLUDING SAME

This invention relates to firearms, and in particular, though not exclusively to an improved sighting means for use with a firearm such as a rifle.

BACKGROUND TO THE INVENTION

Open sights currently in use on firearms, often as back-up for telescopic sights, typically comprise a fixed but adjustable rearsight located about half way down the action and a fixed foresight which is basically an upstanding rib located towards or at the end of the barrel.

There are a number of problems associated with the use of these sights. The adjustment for the sight is provided on the rearsight, the rearsight tends to become bulky and cumbersome, and can easily interfere with the mounting of telescopic sights on the firearm. In addition the "back-up" nature of these types of sights means that they tend to be miniaturised in an attempt to reduce interference with the telescopic sight, and therefore become fiddly and difficult to use.

In addition, even in cases where the rearsight is retractable it also tends to project from the firearm providing something which can be easily snagged when the firer is clambering over fences and through undergrowth.

OBJECT OF THE INVENTION

It is an object of the present invention to provide a sighting means which alleviates in one or more of the areas mentioned above.

Improvements relating to firearms are discussed in our published patent application No GE-A-2305716 the content of which is incorporated herein by way of reference.

SUMMARY OF THE INVENTION

In accordance with a first aspect of the present invention there is provided sighting means for use with a firearm having a barrel, said sighting means including a foresight and a rearsight wherein the foresight is provided with means for releasably connecting the foresight to the barrel of the firearm.

In accordance with a second aspect of the present invention there is provided sighting means for use with a firearm having a barrel, said sighting means including a foresight and a rearsight wherein the foresight is provided with means to enable the sighting means to be correctly calibrated and sighted.

In a preferred embodiment of this aspect of the present invention the foresight may also be provided with means for releasably connecting the foresight to the barrel of the firearm.

One particular embodiment of the present invention comprises sighting means for use with a firearm, said sighting means including a foresight having a main body with an internal bore suitably sized such that the main body can receive the barrel of the firearm, and means for releasably connecting the foresight to the barrel of the firearm.

A sighting means in accordance with the invention has the advantage over conventional sighting means in that it is simple to manufacture and fairly straightforward to operate. Further, since the adjustment in the sighting means is on the foresight, the rearsight can be made more compact and need not interfere with the fixing of a telescopic sight to the firearm. In addition the location of the adjustment in the detachable foresight means that it can be more appropriately sized leading to easier operation.

In one particular embodiment of the present invention the means for releasably connecting the foresight to the barrel comprises a spring-biased body located in the main body with at least a portion thereof biased into/towards the internal bore of the main body, so that it can engage suitable means provided on the barrel of the firearm so as to secure the foresight on the barrel. It could be said that the firearm includes means for co-operating with the spring-biased body.

The spring-biased body may comprise any suitable arrangement which provides in use a releaseable connection between the foresight and the barrel. In one embodiment the spring-biased body comprises a ball bearing which is biased into/towards the bore by a spring means, for example, a compression spring, which transmits force applied by a screw. In this arrangement the screw is turned to adjust the stiffness of this spring-biased arrangement.

In an alternative arrangement the spring biased body comprises a plunger which is biased into/towards the bore by a spring under the influence of an over-centre catch.

The means for co-operating may then comprise a dimple or other indentation formed on the barrel, the indentation being sized to receive the spring-biased body when the foresight is attached to a firearm.

In one particular arrangement the indentation may also be provided with a small groove which runs the end of the barrel. This provides the barrel with guide means to help properly locate the foresight on the barrel of the firearm.

With the above mentioned means for releasably connecting the foresight to the barrel the foresight can be relatively easily disengaged from the barrel without the need for special tools and without materially altering the settings on the foresight, so enabling ready reattachment of the foresight to the barrel of the firearm.

In an alternative embodiment of the present invention the foresight is also provided with more permanent securing means to fix the foresight in position on the firearm should that be required. This additional securing may be any suitable means but should be simple and easy to use while provide effective securing of the foresight to the barrel. In one particular arrangement the additional securing means is a screw which extends through a hole provided in the foresight to engage the barrel, preferable in a recess provided in the barrel, which recess may be threaded to receive the screw.

The foresight may include visual sighting means.

The visual sighting means may comprise a pin which is carried by the main body of the foresight, and in one particular arrangement comprises a threaded member, such as a screw or a nut that is locateable in the main body of the foresight and adjustable with respect thereto.

The pin may be located on the head of the screw or nut in a vertical disposition and be located displaced from the axis of rotation of the screw. In this way the pin can be said to be mounted off centre of the screw or nut so enabling lateral adjustment of the sighting means to allow for climatic conditions, like the wind etc.

The threaded member may be a screw which includes a threaded shank portion which in order to locate the screw in the main body of the sighting means is threadably connectable to a borehole provided in the main body.

In such an arrangement the vertical adjustment ("elevation") of the sighting means is provided by turning the screw or nut by multiple turns, while lateral adjustment ("windage") being provided by smaller turns of the screw or nut to move the pin on the head of the screw off centre. The provision of a fine screw threading in this context will improve the precision of the sighting means will be improved.

In order to enable easy adjustment of the sighting means even when the firer has cold and/or wet hands the head of the screw or nut is preferably provided with gripping means, and in one embodiment of the present invention the head of the screw is knurled to provide the gripping means.

A locking nut or screw, or other means may be provided to preserve the setting of the elevation and windage.

The foresight may be used on its own but is preferably used in conjunction with a rearsight. The rearsight may also be releasably connectable to the firearm or alternatively may be a part of the firearm itself.

The rearsight may be attached to or form part of the action of the firearm, the action being the loading and firing mechanism along with the barrel of the firearm.

In the situation that the foresight has visual sighting means preferably the rearsight also comprises visual sighting means.

In a preferred embodiment the visual sighting means of the rearsight comprises a rigid member which for example has a peepsight aperture formed therethrough and this rigid member may be moved between a first stored position and a second deployed position.

Means may be provided for releasably locking the rigid member in either of the first or second positions.

The rearsight can be compact and lie beneath the base of a telescopic sight when not in use. In one particular embodiment of the present invention the rigid member is suitably shaped so as to be capable of acting also, when stored, as a recoil arrester for a telescopic sight.

The invention further provides a firearm including sighting means comprising the foresight detailed above. The firearm may also include a rearsight as detailed above.

The invention yet further provides a firearm adapted for use with the sighting means of the present invention, whether the sighting means is simply the foresight detailed above or the foresight and rearsight as detailed above.

The barrel of the firearm may, for example, be provided with means for receiving with a spring-biased body and/or a threaded screw carried by the foresight so as to secure the foresight on the barrel.

The firearm can be further adapted for use with a rearsight as hereinbefore defined.

The firearm may for example include a recess for receiving the rearsight the rearsight being retained in association therewith via further releaseable connection means. The recess may be provided in the same position as a mounting for a telescopic sight, in particular where you expect to find the rear mounting leg of the telescopic sight. When the rearsight is fitted to the firearm the reartsight provides a mechanical stop for the telescopic sight and prevents motion of the telescopic beyond certain limits.

The sighting means is usable with most types of firearm and can be manufactured for use with pistols, hand guns, rifles, shotguns, etc. Consequently the term firearm is used to imply any type of firearm whatsoever including those types listed above.

However, the present invention is particularly beneficial for use with rifles, eg. pump or lever action rifles, and more particularly bolt action rifles such as bolt action sporting/hunting/target rifles, where back-up is needed in case of breakdown of a telescopic sight.

DESCRIPTION OF THE DRAWINGS

Embodiments of the invention will now be described, by way of example only, with reference to the accompanying drawings, in which.

DETAILED DESCRIPTION OF THE DRAWINGS

Figure 1:
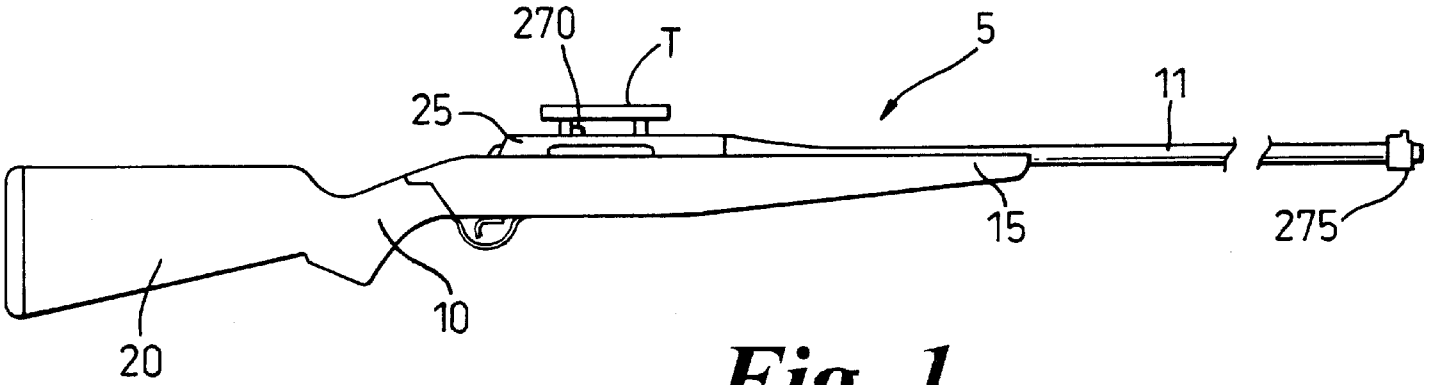
FIG. 1 shows a side view of a rifle which may be fitted with a sighting means according to the present invention.

Referring to FIG. 1 of the drawings there is shown a bolt action rifle 5, made in accordance with the present invention.

The rifle 5 comprises a stock 10 having a fore portion, referred to hereinafter as a forestock 15, and an aft portion, referred to hereinafter as a buttstock 20. The rifle 5 has a loading mechanism and a firing mechanism which in conjunction with barrel 11 of the rifle will be referred to as the action 25, and this action is seated in the stock 10 of the rifle. In this figure the rifle has been shown with telescopic sight where you would normally find such a sight fitted.

The construction and use of the rifle 5 is fully described in published patent application No GB2305716, and the disclosures of this application are incorporated herein by way of reference.

Figure 2:
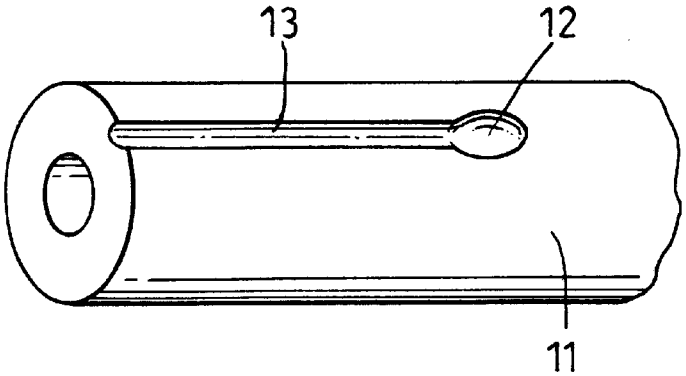
FIG. 2 shows a close up view of the barrel of a firearm adapted to enable fitting of a sighting means in accordance with the present invention.
Figure 3:
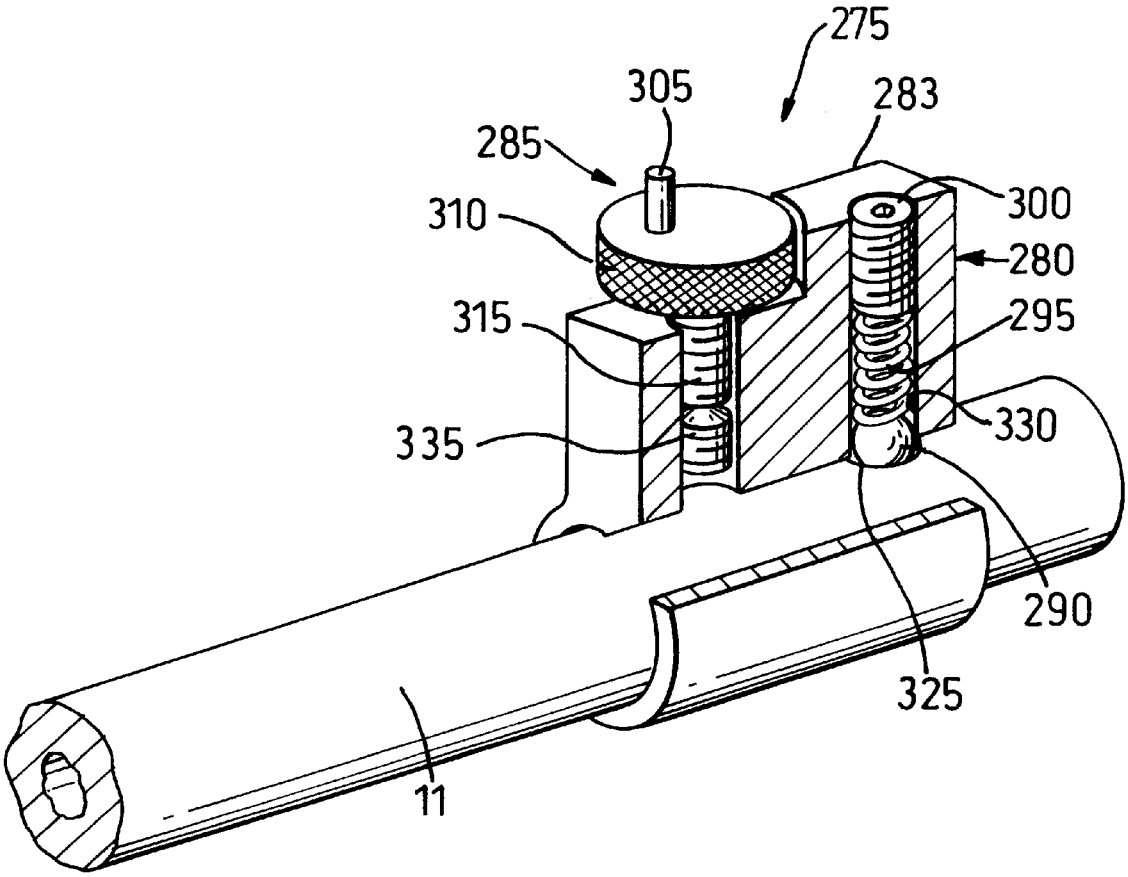
FIG. 3 shows a cut-away perspective view of a foresight assembly forming part of the sighting means of the rifle shown in FIG. 1.
Figure 4A:
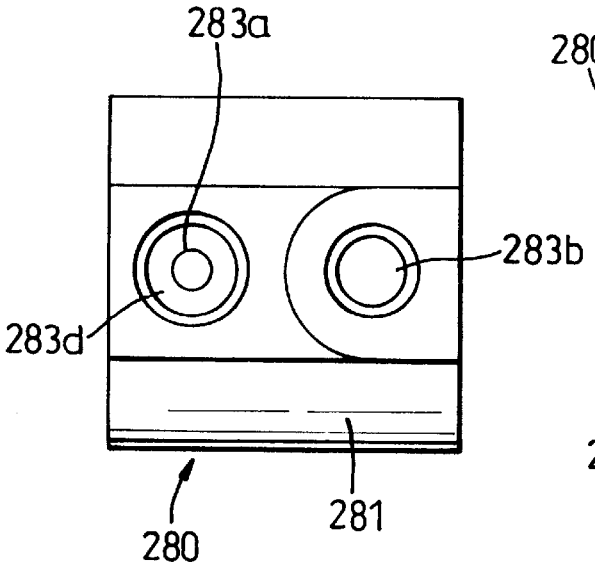
FIGS. 4*a* & 4*b* show plan and sectional side views of the foresight shown in FIG. 3.
Figure 4B:
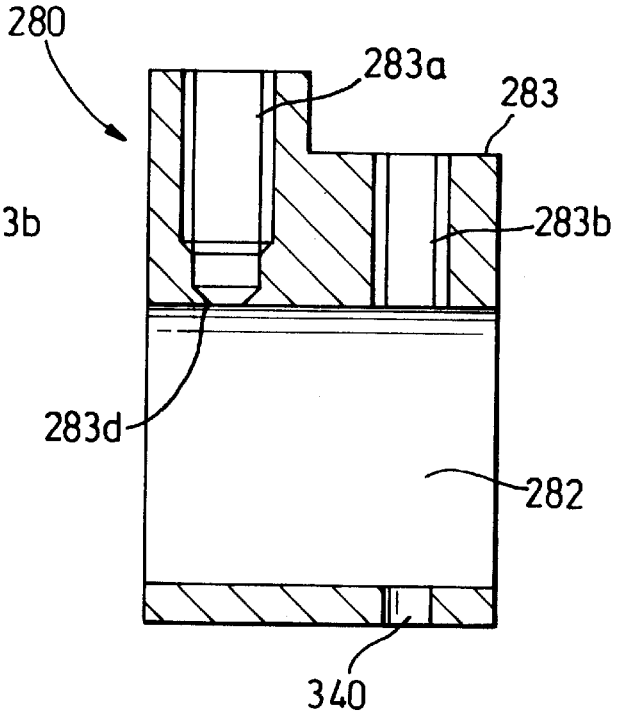
Figure 5:
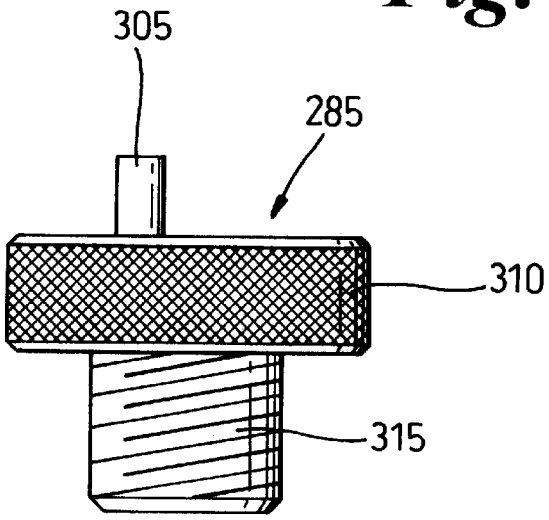
FIG. 5 shows part of the foresight shown in FIG. 3.

The barrel 11 of the rifle 5 is provided with an indentation 12 and a groove 13 extending from the end of the barrel to the indentation as is shown in FIG. 2 of the drawings. This groove provides guide means for the fitting of a removable foresight to the firearm.

The rifle 5 is provided with sighting means which sighting means includes a foresight assembly 275 having means to enable releaseable connection of the foresight assembly 275 to the barrel 11 of the rifle 5, and a rearsight assembly 200.

Referring now to FIGS. 3, 4*a*, 4*b*, and 5 of the drawings there is shown the foresight assembly 275 and various components thereof. The assembly 275 comprising:

- a main body 280 (shown in detail in FIGS. 4*a* & 4*b* of the drawings) having a body portion 281 with a throughbore 282, and an upstanding portion 283, which upstanding portion has a throughbore 283*a* and a borehole 283*b* which is screw-threaded throughout its length;
- a foresight screw 285 (shown in more detail in FIG. 5) located in the borehole 283*b* of the upstanding portion 283;

a ball bearing 290 and spring 295 arrangement located in the throughbore 263*a* of the upstanding portion 283 of the main body 280;

a locating screw 300 locateable in the throughbore 283*a* of the upstanding portion 283 of the main body 280 so as to act against the spring 295;

a further locking screw (not shown) locateable in the borehole 283*b* to lock the foresight screw 285 in place; and a hole 340 provided in the base of the main body 280 to enable means to be applied to the locking screw for adjustment.

The upstanding portion 283 of the main body 280 has a higher section through which the throughbore 283*a* extends and a lower section through which the borehole 283*b* extends. The division between the higher and lower sections forming an arcuate surface. The throughbore 283*a* is a tap hole which is screw threaded and has a shoulder 283*d* circumferentially extending around it's entrance into the throughbore 282. The shoulder extends 30% into the bore of the throughbore so as to retain the ball bearing 290 in place.

The dimensions of the foresight may be altered as appropriate to suit the operating conditions and the gun involved.

The foresight screw 285 acts as a visual sighting means for the firer of the rifle and is locateable in the borehole 283*b* of the upstanding portion 283 of the main body 280. The screw 285 comprises a shank portion 315 which is screw-threaded throughout it's length; a knurled body section 310; and an pin 305 mounted off centre on the upper surface of the body section 310.

The locating screw 300 of the foresight assembly 275 in use is located in the throughbore 283*a* so that it acts against the spring 295, which in turn acts against the ball bearing holding it in position against the shoulder 283*d* of the throughbore 283*a*.

Figure 6:
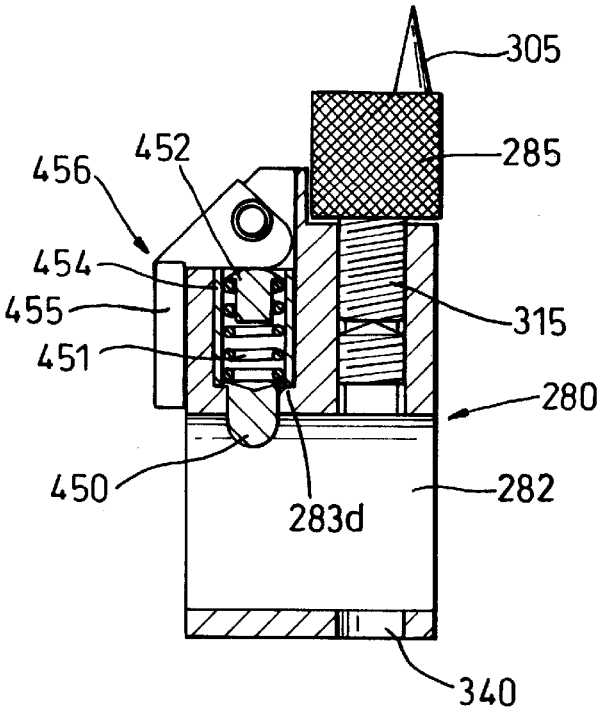
FIG. 6 shows an alternative foresight in accordance with the present invention.

Now turning to FIG. 6 of the drawings there is shown an alternative arrangement for the foresight 275. In this description like components to those described above have been indicated with the same numerals and the description thereof is incorporated herein by way of reference.

The foresight 275 shown here differs from that previously described mainly in the design of the spring biased mechanism that is used to locate and releaseably hold the foresight 275 on the barrel of the firearm. In this example of the foresight instead of the ball bearing and spring arrangement, an assembly with a bullet like member 450, compression spring 451 and plug 452 which are housed in a tube 454 is located in the throughbore 283*b* so that the member 450 protrudes through the opening formed by the shoulder 283*d* into the throughbore 282 of the main body 280.

The assembly is arranged such that compression spring 451 acts against the member 450 with the plug 452 fitted into the spring at the other end thereof.

An overcentre catch 456 having a handle 455 and an elbow shaped section 455 is pivotally mounted to a rib extending down from the higher section to the lower section of the main body 280. In use the handle 455 is used to move the catch between an open position, in which the handle extends into the air, and in which the foresight can be easily snapped or clipped onto the barrel of the firearm, and a lock position in which the bullet shaped member 450 is held firmly in the indentation provided on the barrel of the firearm.

Further, in this example of the foresight 275 the pin 305 of the foresight screw 285 is shown with a tapered profile.

Figure 7:
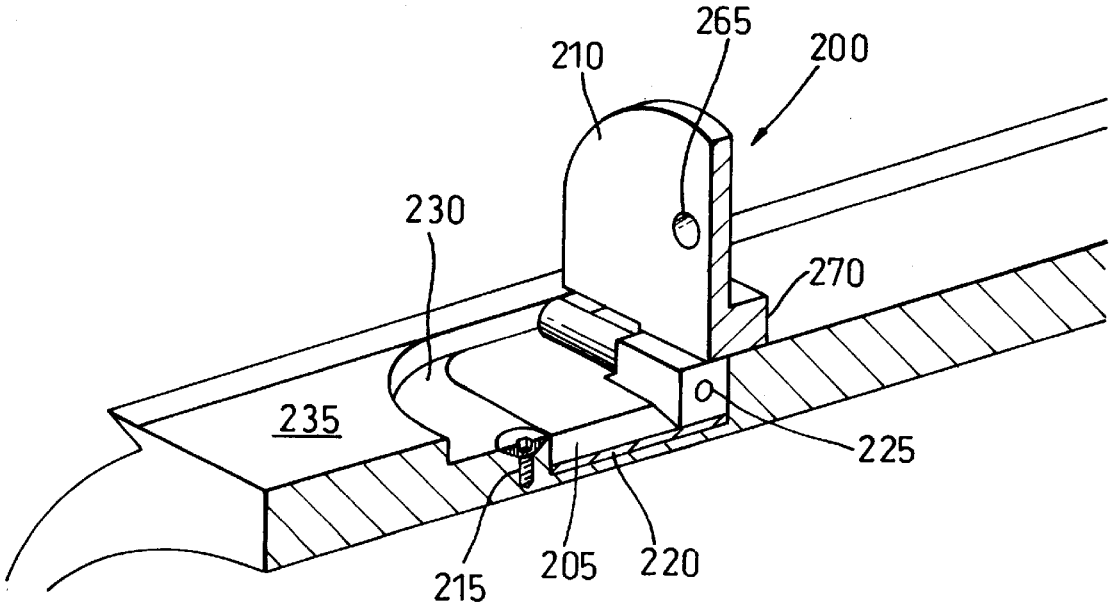
FIG. 7 shows a cut-away perspective view of a rearsight assembly forming part of the sighting means shown in FIG. 1 (shown in a deployed position)

The foresight assembly 275 is a snap-on or clip-on unit which is intended to be used in conjunction with a rearsight assembly 200 such as that shown in FIG. 7 of the drawings as for example a replacement for a telescopic sight.

The rearsight assembly 200 shown comprises a base 205, a combined leaf and recoil stop 210 hingedly connected to the base 205 by a pin 225 and being provided with a peepsight 265 and a mechanical stop 270, a locating screw 215, and spring plate 220 which is held in a dovetail shaped recess 245 in the lower surface of the base 205.

When the rearsight assembly 200 is fitted to the rifle 5 it is located in a machined slot 230 on top of the action 25 which may have been provided to receive a telescopic sight T in FIG. 1, The base 205 of the rearsight assembly 200 is located in the slot 230 so that the leaf and recoil stop 210 can be moved into position for use and the spring plate 220 engages the surface of the slot. The locating screw 215 is now screwed into the action 25 and engages the base 205, possibly by way of a recess provided in the base, to lock the rearsight in position in the slot 230.

Figure 8A:
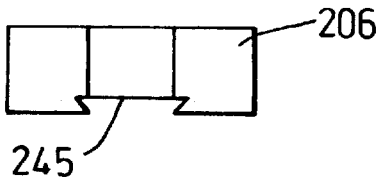
FIGS. 8*a* & 8*b* show the base of the rear-sight as shown in FIG. 7.
Figure 8B:
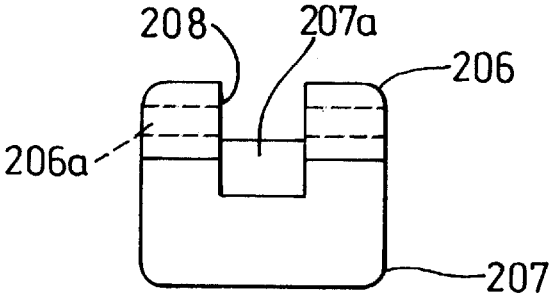

The base 205 of the rearsight assembly 200 is shown in greater detail in FIGS. 8*a* and 8*b* of the drawings and comprises a basically U-shaped member having two arms 206 extending from a body section 207, In a typical example of the rearsight assembly the base 205 forms a basically rectangular plate having rounded corners with cut into the plate a slot 208.

The body section 207 has a section 207*a* inclined at an angle of 45 extending down between the arms 206, each of the arms is provided with an eye 206*a*.

The dovetail 245 in the base 205 extends through the lower surface of the base transversely of what is the body section 207.

The spring plate is of standard configuration and in use is located in the dovetail on the base 205 of the stop 210.

Figure 9A:
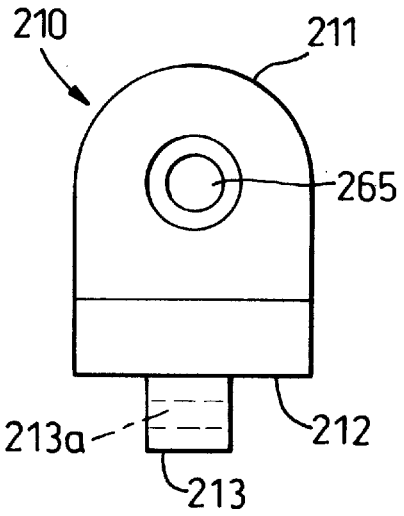
FIGS. 9*a* & 9*b* show the leaf and recoil stop of the rear-sight shown in FIG. 7.
Figure 9B:
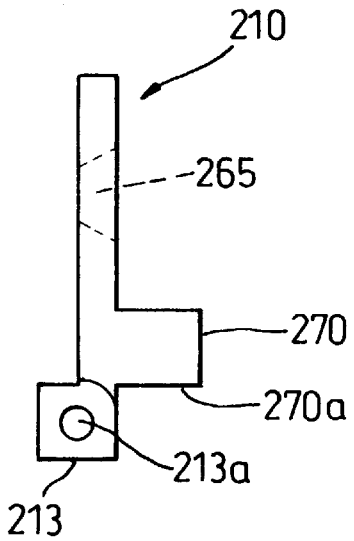

The leaf and recoil stop 210 is shown in more detail in FIGS. 9*a* & 9*b* of the drawings and comprises a plate like member which has a rounded upper edge 211, a lower edge 212, a tongue-like centrally mounted member 213 which extends downwardly from the lower edge 212 over the central part of its length, a peepsight 265, and a mechanical stop 270 extending over the full width of the stop 210 at the lower edge 212.

The peepsight 265 is basically a hole of, for example, 1.5 mm diameter with a bevelled edge that is located centrally of the stop 210.

The mechanical stop 270 on the leaf and recoil stop 210 is in its simplest form a block protruding from the back surface of the stop 210 which in use the lower surface of which engages the action 25 so as to correctly orientate the peepsight for a firer.

The tongue like member 213 fits tightly into the slot in the base 205 and is hingedly mounted to the base 205 by a pin.

In an assembled condition and positioned on a rifle the combined leaf and recoil stop 210 is rotatably mounted to the base 205 by the pin and is movable between a deployed position and a stowed position. In the deployed position the combined leaf and recoil stop 210 projects substantially perpendicularly from the base 205 with the mechanical stop 270 acting against the action 25 of the rifle to prevent over rotation of the stop 210, while in the stored position the combined leaf and recoil stop 210 lies substantially parallel to the base 205 with the mechanical stop protruding upwardly above the action at a point just in front of where the rear mount leg of a telescopic sight would be located. Consequently the mechanical stop will act to prevent any overly forward motion of the telescopic sight due to the recoil from firing of the rifle.

The combined leaf and recoil stop 210 is retained in the deployed position by the action of the spring plate 220 and in the stowed position by the location of the telescopic sight rear mount.

The combined leaf and recoil stop 210 is provided with a peepsight aperture 265 which, when used in conjunction with a foresight, allows the firearm to be aimed.

In fitting to a rifle the foresight assembly 275 may be located on a firearm barrel 11 by the engagement of the locating ball bearing 290 or in the alternative embodiment the bullet-shaped member with the indentation 12 provided in the barrel 11.

The threaded shank 315 of the foresight screw 285 engages with thread of the borehole 283*b* in the upstanding portion of the main body 280. The elevation of the foresight screw 285 relative to the body 280 may be varied by rotating the foresight screw 285 in the borehole 283*b*. The pin 305 provided on the foresight screw 285 acts as a visible sighting element and its off centre position allows adjustment to the amount of sight deflection necessary to compensate for wind displacement when aiming.

Once the foresight has been correctly adjusted and the sighting means has been calibrated the locking screw may be adjusted in the borehole 283*b* to lock the foresight screw 285 in place and maintain the adjustment of the sight. In order to do this a suitable tool may be inserted through the aperture 340 in the underside of the main body 280.

The rearsight assembly 200 is retained in the machined slot 230 by screw 215. When in the stowed position the mechanical stop 270 of the combined leaf and recoil stop 210 stands proud of the rearsight assembly 200 and may act as a recoil arrester for a telescopic sight.

The embodiment of the invention hereinbefore described is given by way of example only, and is not meant to limit the scope thereof in any way.

Particularly it should be appreciated that although the disclosed embodiment shows an advantageous improved sight according to the present invention adapted for use with a bolt action rifle, the invention is not limited to rifles, but is also applicable to other firearms.

Various modifications of the foresight and rearsight are also possible., for example, although the foresight pin 305 is in this embodiment mounted on the head of a screw, as mentioned above it could be mounted on a nut having a female thread which engages a male thread provided with respect to the main body 280 of the foresight.

What we claim is:

1. Sighting means for use with a firearm, said sighting means comprising a foresight having a main body having an internal bore suitably sized such that the main body can receive a barrel of the firearm, and means for releasably connecting the foresight to the barrel of the firearm, wherein the means for releasably connecting the foresight to the barrel comprises a spring-biased body located in the main body with at least a portion thereof biased towards the internal bore of the main body so that it can engage suitable cooperating means provided on the barrel of the firearm to secure the foresight on the barrel.

2. The sighting means as claimed in claim 1 for use with said firearm and a rearsight, wherein the foresight is provided with means to enable the sighting means to be calibrated and sighted.

3. The sighting means as claimed in claim 1, wherein the spring-biased body comprises a ball bearing which is biased towards the bore by a spring means.

4. The sighting means as claimed in claim 1, wherein the spring-biased body comprises a plunger which is biased towards the bore by a spring under the influence of an overcentre catch.

5. The sighting means as claimed in claim 1, in combination with a firearm having a barrel, wherein the means for co-operating comprises an indentation formed on the barrel, the indentation being sized to receive the spring-biased body when the foresight is attached to the firearm.

6. The sighting means as claimed in claim 3, in combination with a firearm having a barrel, wherein the means for co-operating comprises an indentation formed on the barrel, the indentation being sized to receive the spring-biased body when the foresight is attached to the firearm.

7. The sighting means as claimed in claim 1, wherein the foresight further comprises a screw that is locateable in the main body, and adjustable with respect thereto, which screw is provided with visual sighting means in the form of an offcentre mounted pin.

8. The sighting means as claimed in claim 7, wherein the screw includes a threaded shank portion which in order to locate the screw in the main body of the foresight is threadably connectable to a borehole provided in the main body of the foresight.

9. The sighting means as claimed in claim 3, wherein the sighting means also includes a rearsight.

10. The sighting means as claimed in claim 9, wherein the rearsight comprises visual sighting means which comprise a rigid member moveable between a first stored position and a second deployed position.

11. The sighting means as claimed in claim 10 wherein there are provided means for releasably locking the rigid member in either of the first or second positions.

12. A firearm including sighting means comprising the foresight as claimed in claim 3.

13. A firearm in combination with the sighting means as claimed in claim 9.

14. A firearm in combination with the sighting means as claimed in claim 10, wherein the rearsight in the stored position acts as a mechanical stop for a telescopic sight fitted to the firearm so as to prevent forward motion of the telescopic sight.

15. The firearm and sighting means as claimed in claim 13, wherein the barrel of the firearm is provided with means for co-operating with at least one of the spring-biased body and a threaded screw carried by the foresight so as to secure the foresight on the barrel.

16. The firearm and sighting means as claimed in claim 13, wherein the firearm includes a recess for receiving the rearsight, the rearsight being retained in association therewith via further releaseable connection means.

* * * * *